US007880612B2

(12) United States Patent
Caswell

(10) Patent No.: US 7,880,612 B2
(45) Date of Patent: Feb. 1, 2011

(54) ANTI-THEFT METHOD AND DEVICE

(76) Inventor: Gary Caswell, 4556 Wintercreek Rd. SE., Jefferson, OR (US) 97352

( * ) Notice: Subject to any disclaimer, the term of this patent is extended or adjusted under 35 U.S.C. 154(b) by 303 days.

(21) Appl. No.: 12/286,819

(22) Filed: Oct. 2, 2008

(65) Prior Publication Data

US 2010/0085189 A1 Apr. 8, 2010

(51) Int. Cl.
*G08B 13/14* (2006.01)

(52) U.S. Cl. ..... 340/571; 340/561; 340/564; 340/541; 340/550; 340/635; 340/644; 340/660; 256/2; 256/7; 256/10; 256/48; 700/284

(58) Field of Classification Search ..... 340/571, 340/561, 564, 541, 550, 635, 644, 660; 256/2, 256/7, 10, 48; 700/284
See application file for complete search history.

(56) References Cited

U.S. PATENT DOCUMENTS 4,198,653 A 4/1980 Kamin
4,318,088 A * 3/1982 Hunter ..... 340/541
4,418,337 A 11/1983 Bader
4,523,187 A 6/1985 Begg
5,550,530 A 8/1996 Hamm
5,852,402 A * 12/1998 Perry ..... 340/541
5,867,099 A 2/1999 Keeter
5,982,291 A 11/1999 Williams
6,069,655 A 5/2000 Seeley
6,456,198 B1 * 9/2002 Kato et al. ..... 340/564
6,798,344 B2 9/2004 Faulkner

* cited by examiner

*Primary Examiner*—Tai T Nguyen
(74) *Attorney, Agent, or Firm*—Crowell Ing, LLP; Nye Wang; Carl D. Crowell

(57) ABSTRACT

The invention comprises of a method and alarm device used to prevent metal theft from irrigation systems. The alarm device attaches to a plurality of electric conductor such as copper wiring that is in need of protecting and the preexisting irrigation system circuit. The alarm device detects voltage in the irrigation system circuit and if there is no voltage signals from the irrigation system circuit, then the alarm device automatically breaks the original circuit and inserts itself into the irrigation system circuit. The alarm device then sends a low voltage, low current down the plurality of electric conductors and the plurality of conductors then become part of a circuit that energizes a magnetic switch located in the alarm device. A breach of integrity of the plurality of conductors such as by physical detachment triggers an alarm condition which lead to audio and visual alarms plus activating an automated dialer.

18 Claims, 6 Drawing Sheets

ANTI-THEFT METHOD AND DEVICE

FIELD OF THE INVENTION

The invention relates to systems for preventing the theft of copper wire, conductors and similar materials.

BACKGROUND OF THE INVENTION

Fueled by economic growth, worldwide demand for metals such as copper has risen over the past several years. Supply has been unable to keep pace, pushing prices dramatically upward, particularly from 2003 through 2006 when the price per pound of copper rose from around $0.70 to as high as $4.00 by mid-2006.

Tight supplies have led to an increase in copper recycling, which, in turn, has created a market for used copper and made the material a more attractive target for theft. In fact, thefts of copper wire have been on the rise across the United States, with no apparent geographic pattern and all sectors that use the material, including electric utilities and agriculture are being targeted.

Thefts of copper wire from the agricultural industry typically occur from irrigation systems. High-tech irrigation systems which maximize yield and minimize water use may contain 100 or more pounds of copper wire in a single field. When combined with the remote location of most agriculture, intermittent use and the value of the copper, irrigation systems has become a prime target for metal thieves.

The damage done by this type of theft extends beyond the loss of the wire, as the theft is often damaging to both the underlying equipment and may result in loss of agricultural productivity as crops go unwatered. Aside from the obvious economic impact, and service disruptions are the possibility of personal injury for persons involved in the theft or subsequent recovery efforts.

Beside the best efforts of working closely with scrap metal dealers and law enforcement, active counter measures to protect the wire are still largely absent. A number of prior conventional approaches exist in guarding from general theft such as motion detecting alarm systems, electric fencing, and video monitoring devices. However none of the conventional approaches are adequate solutions for farming equipment such as pivot irrigation systems because of their size, and remote location. Furthermore, none of these traditional theft prevention methods have been adapted to work with irrigation systems.

U.S. Pat. Nos. 5,867,099, 4,418,337 and 4,472,879 are just a few examples of prior arts that teach of motion sensor alarm systems. However, because of the remote locations of irrigation pivots and other remote targets of copper theft, the use of motion sensers is just not practical. The remote locations are often populated by native wildlife such has deer and like animals that would surely lead to frequent false alarms. Also unlike enclosed locations, these target equipment are out in the elements and are subject to strong wind and rain which can create problems for any motion sensing alarm systems. Furthermore, irrigation systems can span hundreds of feet and the application of motion sensors to cover that distance would be economically infeasible.

U.S. Pat. Nos. 4,198,653, 6,798,344 and 6,069,655 are a few examples of the vast number of prior arts focusing on video surveillance. However irrigation pivots and other equipment located in remote locations will have limited source of power to work the cameras. In addition, the lack of light source plus the need for continuous monitoring play a significant factor when cost is concerned. Once again due to the remote and open location, elements such as rain, snow or wind can all decrease the effectiveness of any kind of video surveillance system.

U.S. Pat. Nos. 4,523,187, 5,982,291 and 5,550,530 are some examples of electric fencing and perimeter monitoring devices. However, this method of theft prevention is somewhat impractical when trying to protect irrigation systems and other equipment subject to metal theft found in remote locations. In addition, the cost of constructing and maintaining such fencing would be extensive.

Therefore, a need exists to provide an affective means to monitor copper wire and other conductors and to activate an alarm in the event of an attempted theft that is economical justifiable. A further need exists for remote monitoring of items such as crop irrigation systems to report the status of the equipment and to provide notice of possible theft and take steps in scaring thieves and preventing the theft.

The system of the present invention for monitoring, warning and preventing of metal theft provides a solution to all of the above-described needs. The cost of the present invention is minimal in comparison to conventional security systems such as electric fencing, video monitoring, and motion sensing. The present invention provides an alarm system that directly attaches to any preexisting irrigation control system and constantly monitors the system and its valuable metal wiring, such as electric conductors in the form of copper wiring. The present invention can effectively protect the electric conductors by the use of audio and visual alarms plus activate an automated phone dialer to notify of the possible attempt of metal theft.

SUMMARY OF THE INVENTION

The present invention teaches of a method and device that is designed to alert and prevent metal theft. The metal protected can be any electric conductors such as copper, steel, aluminum, gold, silver, etc.

The invention comprises of an alarm device which is attached to the electric conductors that are in need of protecting. The alarm device also may be attached to the preexisting irrigation system circuits that are used to control or power the irrigation machine. The alarm device detects voltage in the irrigation system circuits and if the voltage is present the device logic of the alarm device turns off the alarm device and the voltage signal passes as if the alarm device is not present. If there is no voltage signals from the irrigation system circuit, then the alarm device automatically breaks the original circuit and inserts itself into the irrigation system circuit. The alarm system then sends a low voltage, low current down a plurality of electric conductors and the plurality of electric conductors then becomes part of a circuit that energizes a magnetic switch located in the alarm device. A breach of integrity of the plurality of conductors such as by physical detachment triggers an alarm condition. The removal of the power source of the alarm device will activate the alarm device's backup power supply and will also trigger an alarm condition.

The alarm condition may lead to a local alarm consisting of sirens, flashing lights or any other tactic of scaring off trespassers known in the art. The alarm condition may also trigger an automated phone dialer that will then contact the owner or authorities of the breach. The alarm condition may also trigger a remote alert in which the alarm device transmits by radio waves to a remote receiver that may further consist of an automated dialer and/or sirens. The benefit of the optional remote receiver is to keep an independent power source and phone dialer far away the site of the theft. An additional benefit to the remote receiver is that the phone dialer in the remote receiver can be placed next to a land phone line. Although a land line is optional if a wireless dialer is used. The message being sent through the automatic phone dialer may be different depending on the type of breach and alarm action.

DETAILED DESCRIPTION OF THE INVENTION

Figure 1:
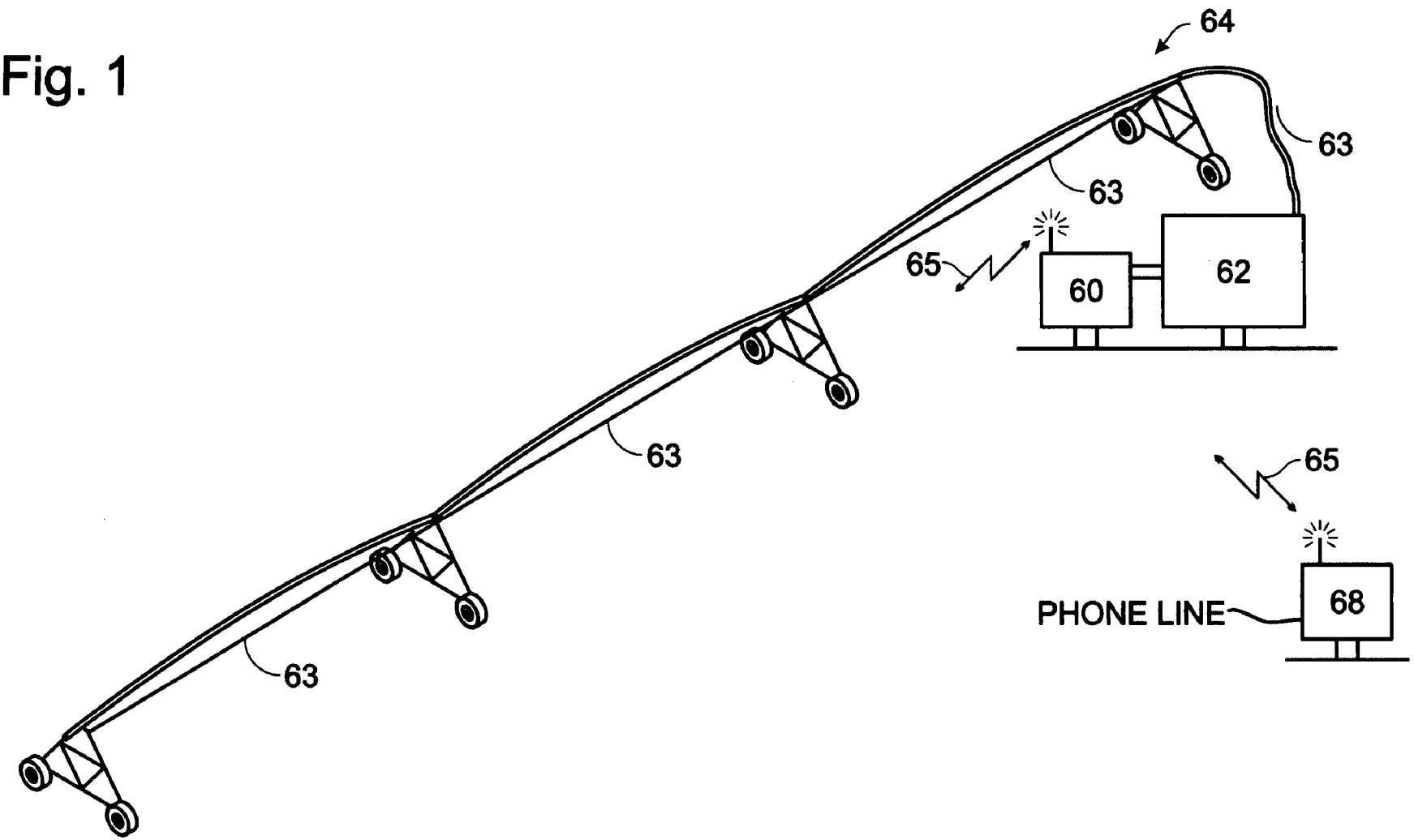
FIG. 1 is an illustration showing the various major components of the system of the present invention and their communication paths.

FIG. 1 shows all the major components of the system of the present invention and their communication paths in the preferred embodiment. The irrigation machine 64 contains electric conductors 63 which in the preferred embodiment are in the form of copper wiring. The irrigation system 62 controls the irrigation machine through the copper wiring 63. The present invention contains the alarm device 60 which connects to both the irrigation system control 62 and the copper wiring 63 in which the device seeks to protect. The alarm device in the preferred embodiment will communicate with a remote receiver 68 which houses an automotive dialer that can alert the authorities or the owner of the irrigation system.

Figure 2:
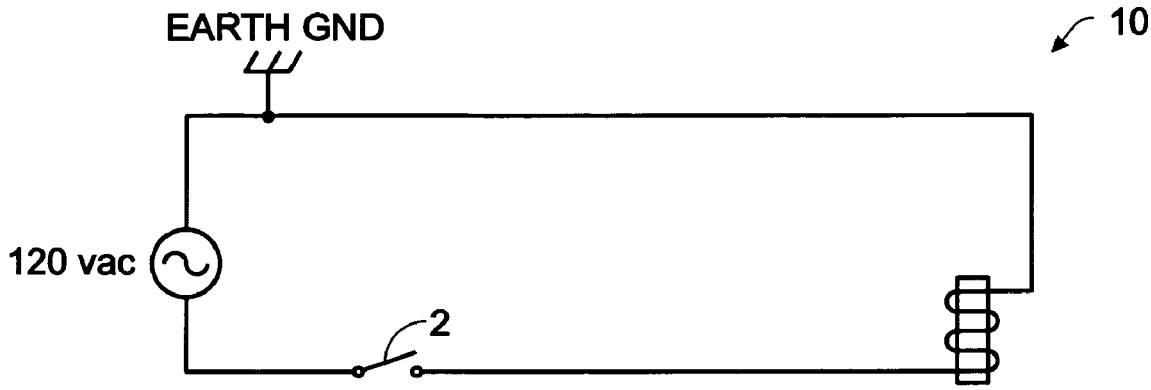
FIG. 2 is a circuit diagram showing the basic circuits of a circle pivot irrigation end tower control without the alarm device attached.
Figure 3:
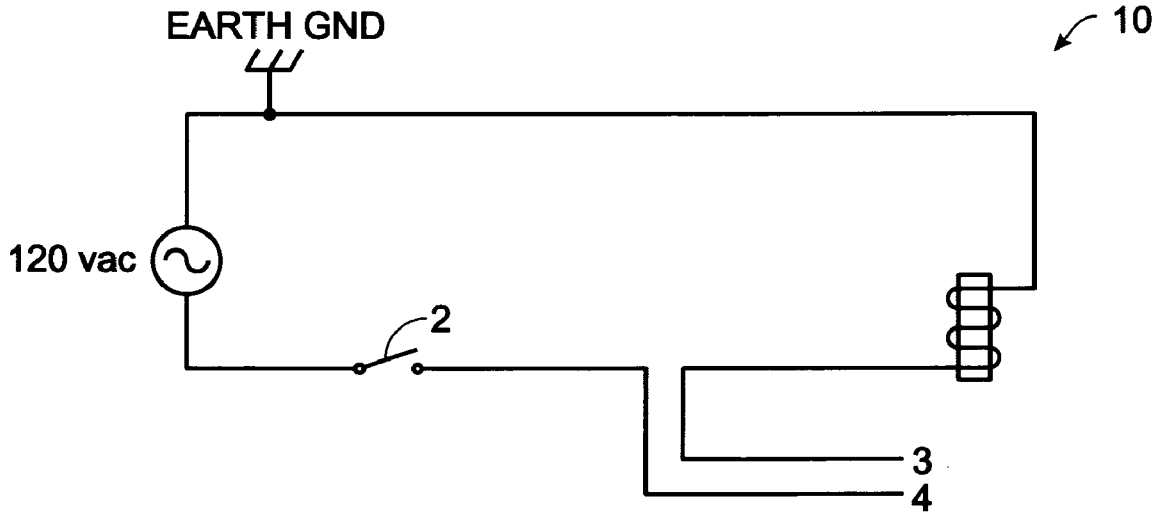
FIG. 3 is a circuit diagram showing the basic circuits of a circle pivot irrigation end tower control with the alarm device attached.

Irrigation systems come in many forms. One form of irrigation system is the circle pivot system. Circle pivot systems are typically under control of control circuits 10 as seen in FIG. 2, which controls the direction of the pivot, the time of application and other operational parameters. FIG. 3 shows the same control circuits 10, but integrated into the alarm device 60, wherein 3 is the connection out of the alarm device, and 4 is the connection into the alarm device.

Figure 4:
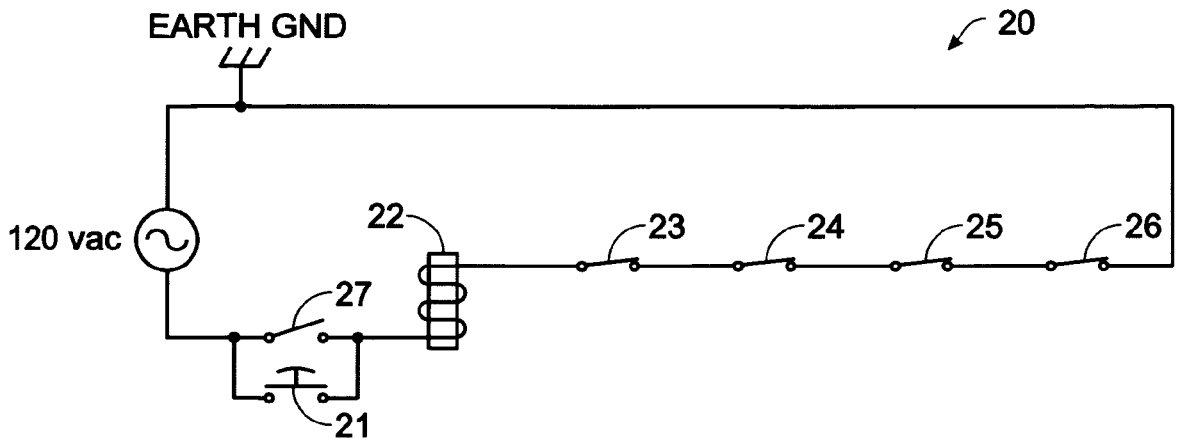
FIG. 4 is a circuit diagram showing the basic safety circuit of a lateral irrigation system without the alarm device attached.
Figure 5:
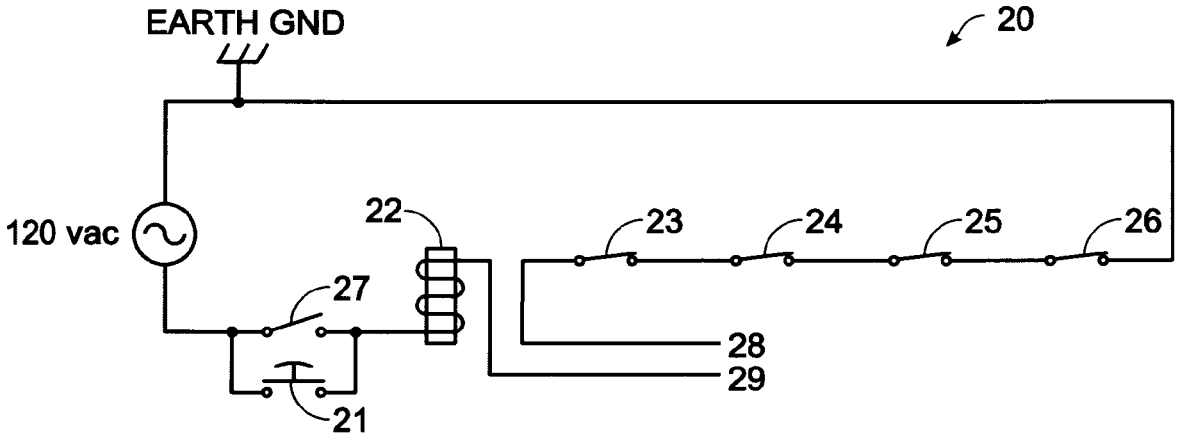
FIG. 5 is a circuit diagram showing the basic safety circuit of a lateral irrigation system with the alarm device attached.

Another very popular irrigation system is the lateral irrigation system, and the basic safety circuit 20 for the lateral irrigation system can be seen in FIG. 4. 21 is the irrigation system start push button, 27 is the main contactor auxiliary contact, 22 is the main contactor coil, and 23-26 are the lateral tower box safety switches which may vary with irrigation system length. FIG. 5 shows the same basic lateral irrigation system connected to the alarm device 60 with 28 connecting out of the alarm device and 29 connecting into the alarm device.

Figure 6:
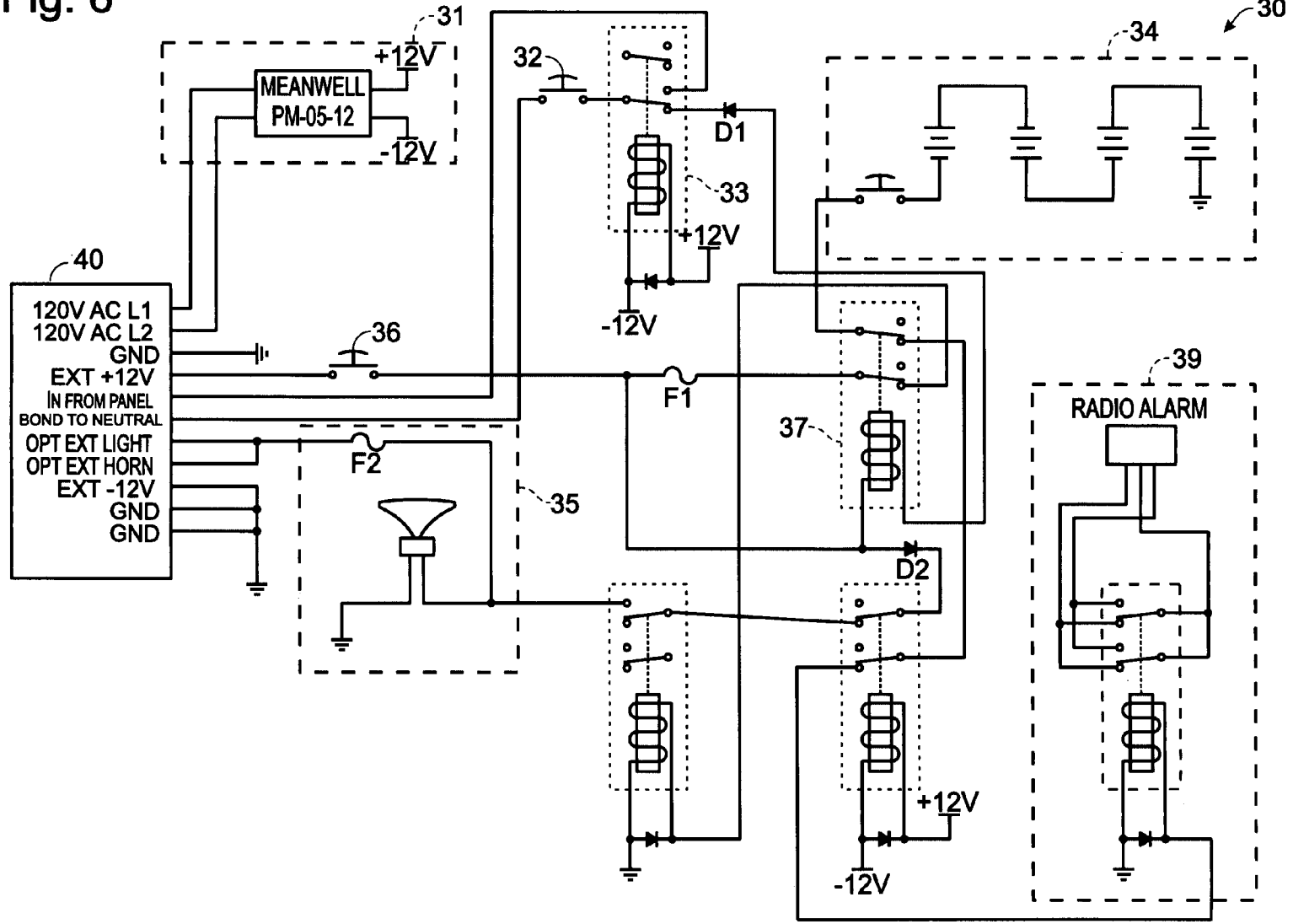
FIG. 6 is a circuit diagram of the alarm device in the preferred embodiment.

Once the alarm device is connected to the irrigation control system circuits 10 or 20, which is housed in the irrigation control system 62, the alarm device monitors to see if the irrigation system is active. FIG. 6 shows the circuit diagram 30 of the alarm device 60. The alarm device is powered by the outside power source 31. 32 is the test point in which the alarm device monitors the irrigation circuit for activity. If no activity is found the external power source 31 is used to send a low voltage, low current down a pair of copper wiring 63 and these copper wiring 63 become part of a circuit at key point 36 that energizes a control relay 37. As long as the copper wiring 63 are in place and connected, control relay 37 stays magnetized and nothing happens. However, if the integrity of the copper wiring 63 is breached, or the external power source is disconnected, the control relay is de-energized which would activate the internal backup battery source 34, which then triggers the radio alarm 34 and the audio and visual alarm 35. The radio alarm 34 would then facilitate a transmitter which will broadcast using 900 MHz radio signals. The transmitter is not shown but is well known in the art. The transmitter may be programmed to transmit different signals for different occurrences. For example, the signals would be different dependent on whether the copper wiring was cut or whether the power supply failed.

Figure 7:
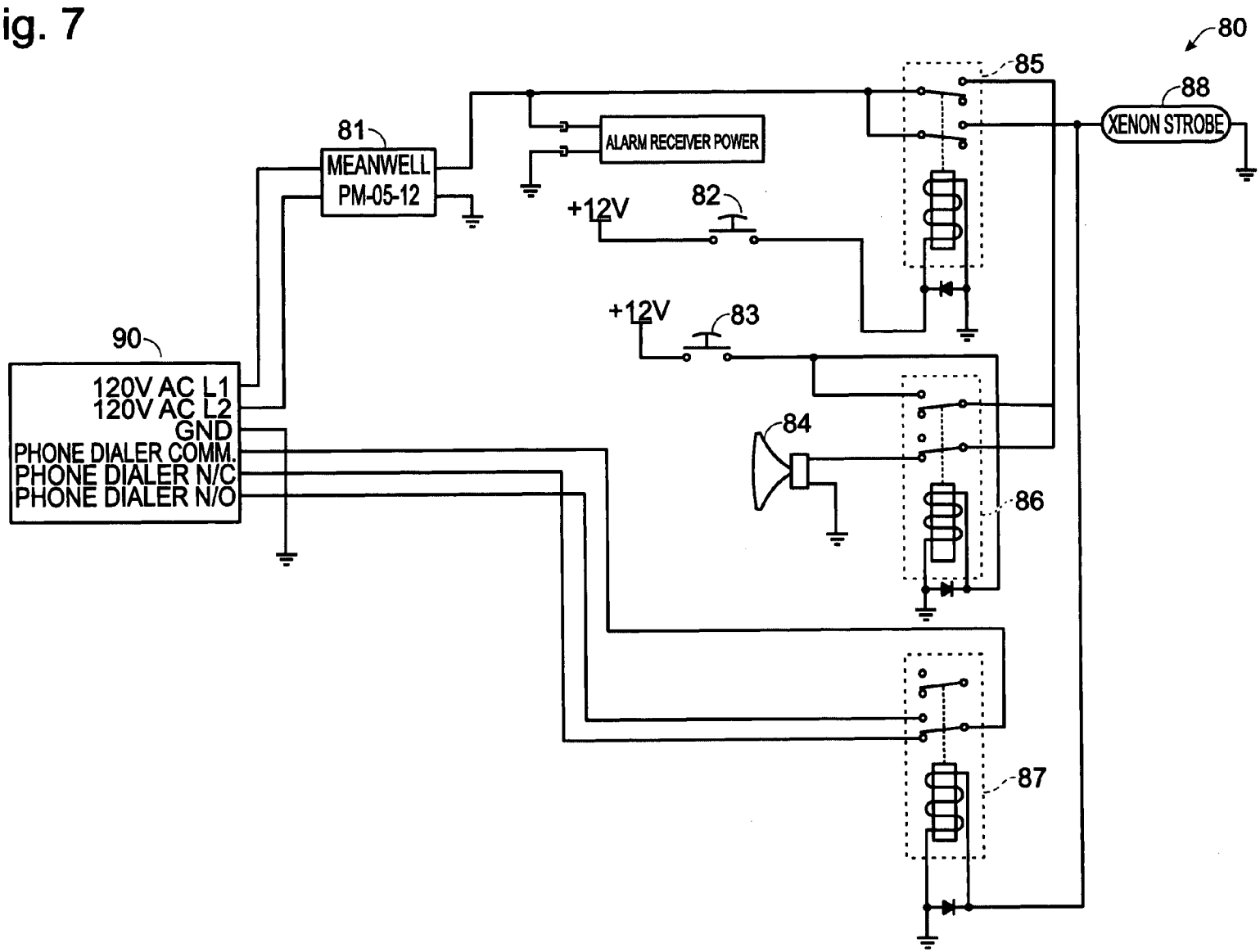
FIG. 7 is a circuit diagram showing the receiver device in the preferred embodiment.

FIG. 7 shows the circuit diagram 80 of the remote receiver 68. The remote receiver is powered by an external power source 81 which connects to terminal block 90. The remote receiver facilitates a 900 MHz receiver that will trigger alarm contact 82 when an alarm condition is activated by the alarm device 60. If an alarm condition is present, control relay 85 is energized causing the activation of xenon strobe lights 88, and then through control relay 86 activates an audio alarm 84 which can be silenced through a silence button 83. In addition to the audio alarm, an automated phone dialer will be activated through the energizing of control relay 87. A 900 MHz receiver is located in the remote receiver 68 and should have the capability of detecting different signals from the transmitting receiver located in alarm device 60. The 900 MHz transmitter and receiver are not shown but are well known in the arts. An automated phone dialer is used in the remote receiver 68. The automated phone dialers can be programmed to send different messages by phone to authorities and property owner according to the type of signals received by the 900 MHz receiver. The automated phone dialer is not shown but is well known in the art. Depending on the type of automated phone dialer, a land line may be needed.

Figure 8:
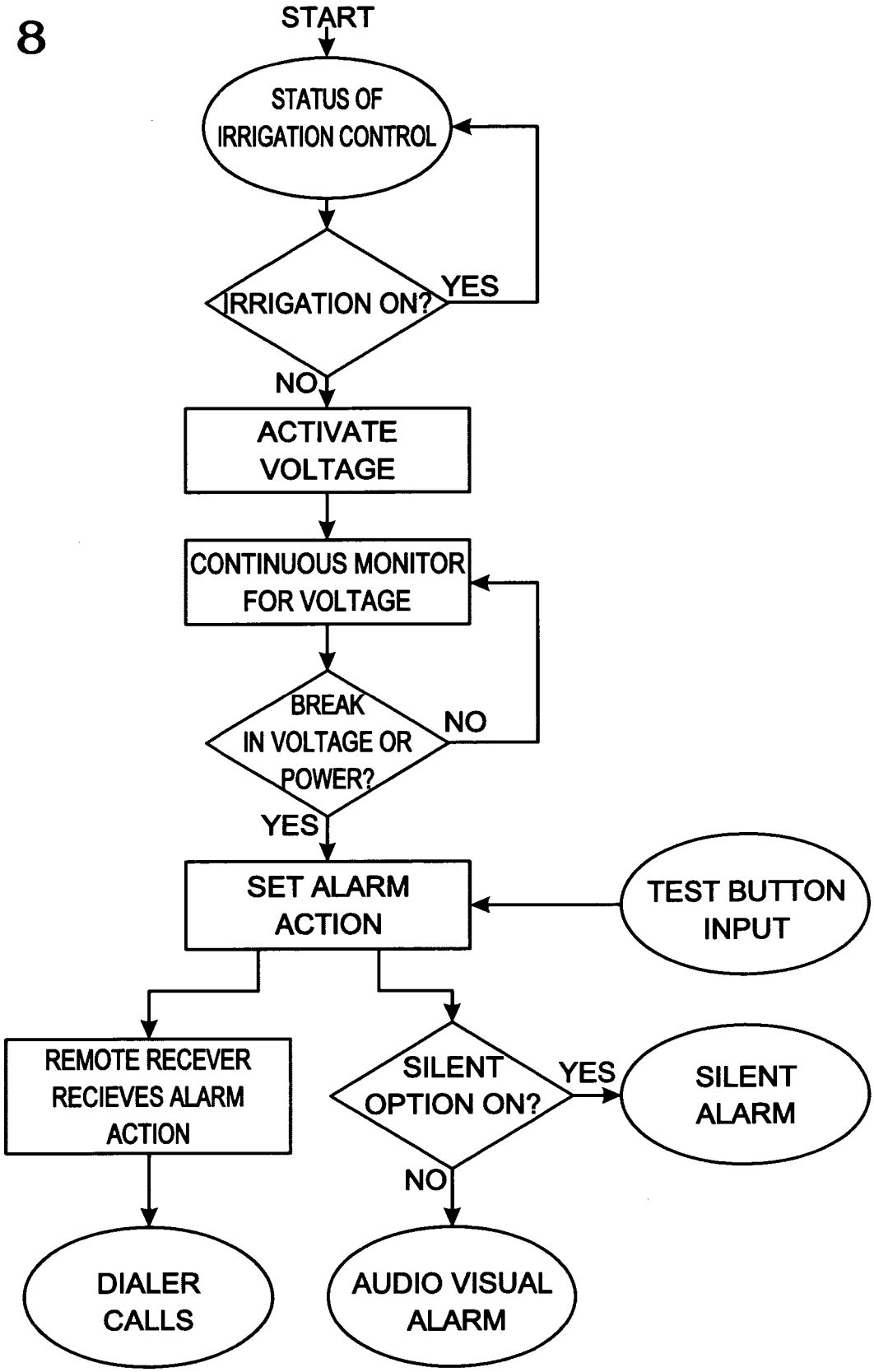
FIG. 8 is a flow chart illustrating a method of the invention in the preferred embodiment.

FIG. 8 illustrates the method of protecting the coppered wiring in this preferred embodiment. Start by connecting the alarm device 60 to the copper wiring 63 and the circuit of irrigation system 62. Then move to step 100 where the status of the irrigation system is monitored for activity by sensing for voltage. Step 110 decides if the irrigation system is off or on. If the irrigation system is on or turned on then the alarm device does not connect to the circuitry of the irrigation device and stays inactive. If the irrigation system is not on, then it moves to step 120 where the alarm device sends low voltage and current into the protected conductors, which in this preferred embodiment comprises of a plurality of copper wiring, and then moves to stop 130. In step 130 the alarm device continuously monitors for the voltage running through the copper wiring. Step 140 determines if there is an integrity breach in the copper wiring which would be the result if thieves cut the wiring thus preventing the low voltage from being detected. An alarm action would be triggered and then it moves to step 150.

In step 150 two things will happen. First the alarm device will send out a radio signal, in which the signal depends on type of alarm action. For example there can be a signal when the batteries are low, and there can be a different signal if the copper wiring is cut. The signal is then processed in step 200 where a remote receiver collects the signals and activates an automotive phone dialer in step 210 that will send a phone message to the authorities or the owner of the property. The phone message can be tailored dependant on the type of alarm action. Step 150 also will lead the alarm device to move to step 160 where it determines if the owner of the device wants an audio alarm or a silent alarm. If the silent alarm option is picked, no audio alarm is activated and the process ends in step 190. If no silent option is picked, the process will end in step 170 where horns, sirens, and other similar steps are used to scare off intruders. Step 180 allows user to test all the steps following step 150 by using a test feature that simulate an alarm action.

Throughout the specification the aim has been to describe the invention without limiting the invention to any one embodiment or specific collection of features. Persons skilled in the relevant art may realize variations from the specific embodiment that will nonetheless fall within the scope of the invention. For example, the conductors being monitored and protected is not limited to just copper wiring and can be any other metal conductors such as steel, silver, aluminum, etc. The irrigation systems are not limited to circular or lateral systems. The connection of the alarm device to the irrigation circuitry is not limited to just the lateral safety circuit or the circle pivot control circuit. The connection of the alarm device to the electric conductors is not limited to a pair of copper wiring but can be any amount. The remote receiver is optional and can be integrated into the alarm device if a phone line is near the irrigation system. The type of transmitters, receivers, and phone dialers used can be anything known in the arts. Accordingly, the scope of the invention should be determined not by the embodiments illustrated, but by the appended claims and their legal equivalents.

I claim:

1. A method for preventing theft of electric conductors comprising:

a. attaching an alarm device to a preexisting irrigation system circuit;

b. attaching said alarm device to plurality of electric conductors found in a irrigation system;

c. detecting when said irrigation system circuit is active or inactive;

d. supplying a continuous voltage to said plurality of electric conductors when said irrigation system circuit is inactive;

e. monitoring said continuous voltage to detect for integrity breach in said electric conductor; and f. triggering an alarm action when there is a integrity breach in said electric conductors.

2. The method of preventing theft of electric conductors in claim 1, further comprising of attaching a remote receiver some distance away from said alarm device and wherein the said remote receiver is adapted to communicate with the said alarm device.

3. The method for preventing theft of electric conductors of claim 2 wherein the said alarm action comprises of sending a radio signals to said remote receiver.

4. The method for preventing theft of electric conductors of claim 2 wherein the said remote receiver contains an automated dialer system.

5. The method for preventing theft of electric conductors in claim 1, further comprising a testing option that activates said alarm system for testing purposes.

6. The method for preventing theft of electric conductors of claim 1 wherein the said alarm system comprises of an audio alarm.

7. The method for preventing theft of electric conductors of claim 1 wherein the said alarm system comprises of a visual alarm.

8. The method for preventing theft of electric conductors of claim 1 wherein the said alarm system comprises of a silent alarm.

9. The method for preventing theft of electric conductors of claim 1 wherein the said alarm system comprises of an automated dialer system.

10. The method for preventing theft of electric conductors of claim 1 wherein the said plurality of electric conductors are in the form of coppering wiring.

11. An anti-theft device for electric conductors comprising:

a. an alarm device adapted for connection to a preexisting irrigation system circuit and a plurality of electric conductors b. means for said alarm device of detecting voltage in said preexisting irrigation system circuit;

c. means for said alarm device of supplying a continuous voltage to said plurality of electric conductors when no voltage is found in said preexisting irrigation circuit d. means for said alarm device of detecting said continuous voltage to said plurality of electric conductors and providing an alarm action when the said continuous voltage to said plurality of electric conductors is disrupted.

12. The anti-theft device for electric conductors in accordance to claim 11 further comprising of a remote receiver adapted to communicate with said alarm device.

13. The anti-theft device for electric conductors in accordance to claim 12 wherein the said remote receiver comprises of an automated dialer system.

14. The anti-theft device for electric conductors in accordance to claim 12 wherein the said alarm action includes means for broadcasting an alarm signal to the said remote receiver.

15. The anti-theft device for electric conductors in accordance to claim 12 wherein the said alarm action includes means for wirelessly broadcasting of alarm signals to the said remote receiver.

16. The anti-theft device for electric conductors in accordance to claim 11 wherein the said alarm action includes an audio alarm.

17. The anti-theft device for electric conductors in accordance to claim 11 wherein the said alarm action includes a visual alarm.

18. The anti-theft device for electric conductors in accordance to claim 11 wherein the said plurality of electric conductors are in the form of copper wiring.

* * * * *